United States Patent [19]

Baker et al.

[11] Patent Number: 4,551,035

[45] Date of Patent: Nov. 5, 1985

[54] MARKING INSTRUMENT

[75] Inventors: Hugh W. B. Baker, Beaconsfield; Robert White, Cholsey, both of England

[73] Assignee: The Gillette Company, Boston, Mass.

[21] Appl. No.: 558,658

[22] Filed: Dec. 6, 1983

[30] Foreign Application Priority Data

Dec. 8, 1982 [GB] United Kingdom ..... 82 34981

[51] Int. Cl.[4] ..... B43K 22/04

[52] U.S. Cl. ..... 401/104; 401/106

[58] Field of Search ..... 401/104, 105, 106, 82, 401/83, 84

[56] References Cited

U.S. PATENT DOCUMENTS

| | | | |
|---|---|---|---|
| 2,722,914 | 11/1955 | Aversa | 401/105 |
| 3,265,201 | 8/1966 | Edwards | 401/84 |

FOREIGN PATENT DOCUMENTS

| | | | |
|---|---|---|---|
| 1236371 | 3/1967 | Fed. Rep. of Germany | 401/104 |
| 67718 | 3/1958 | France | 401/104 |
| 542782 | 1/1942 | United Kingdom . | |
| 979882 | 1/1965 | United Kingdom | 401/104 |
| 1192116 | 5/1970 | United Kingdom . | |
| 818917 | 4/1981 | U.S.S.R. | 401/104 |
| 818918 | 4/1981 | U.S.S.R. | 401/104 |

*Primary Examiner*—Steven A. Bratlie

*Attorney, Agent, or Firm*—John P. Morley

[57] . ABSTRACT

A marking instrument in which the marking element is advanced and retracted by the action of a sliding member integral with a cantilever spring which employs detent means for releasably locking the slide member in forward or retracted position.

8 Claims, 7 Drawing Figures

MARKING INSTRUMENT

BACKGROUND OF THE INVENTION

It is well known for marking instruments, especially pens, to be provided with retraction mechanisms which enable the marking or writing tip to be retracted into the body during periods of non-use. Generally speaking, the known retraction mechanisms are rather complicated and are too expensive to manufacture to make it economical for them to be incorporated in so-called disposable pens which are intended to be discarded when the ink reservoir has run dry. Consequently, nearly all disposable pens available on the market have permanently exposed writing tips and are provided with removable caps adapted to be fitted over the tips. Removable caps are inconvenient because they are easily misplaced and lost.

In British patent specification No. GB 979882, there is proposed a retractable ball-point pen in which an ink reservoir tube and writing tip are advanced and retracted relative to the pen body by a plunger received in an axial bore extending through the body. The plunger includes a leaf spring at one side and a projecting tooth at the other side adapted to engage in a hole in the body to retain the plunger in its adjusted position. The plunger is of smaller diameter than the bore so that it can move laterally relative to the body for the tooth to engage and disengage the holes. Because the plunger can move from side to side, the ink tube is not firmly supported in the lateral direction, which can detract from the writing characteristics of the pen, and the retraction mechanism may itself have a floppy feeling to it.

British patent specifications No. GB 542,782 and No. GB 1,192,116 also show writing instruments in which a pencil lead or ink reservoir tube and writing tip are advanced and retracted relative to the instrument body by a plunger which moves axially of the body.

SUMMARY OF THE INVENTION

The present invention seeks to provide a solution to the above problem and accordingly provides a marking instrument comprising a body having a longitudinal bore, a marking element accommodated in the bore, a member received in the bore for moving the tip of the marking element from a retracted position to an extended position relative to the body, detent means on the member and body engageable under a spring bias for locking the member releasably in a forward position in the bore, and a projection on the member protruding through a slot in the body for disengaging the detent means and for adjusting the member from a retracted position to the forward position, characterized in that the member is a slide member including a first part having portions in close sliding fit engagement with the bore at positions spaced apart along the bore whereby the slide member is guided for movement axially of the bore, on a second part projecting longitudinally from the first part and forming a cantilever spring, the spring providing the spring bias for the detent means and carrying said projection for disengaging the detent means.

The retraction mechanism embodied in an instrument according to the invention is simple in construction and operation, inexpensive to manufacture and ensures secure retention of the marking tip in its adjusted position. Furthermore it is not required to move and can therefore provide firm lateral support for the writing element.

In a preferred construction, the first part of the slide member comprises an elongate element of smaller cross-section than the bore and guide portions spaced apart along the element, for example integral collars located adjacent the ends of the elongate element, having a sliding fit in the bore. By this form of slide member, there is achieved a positive axial guide with low friction between the slide member and body.

BRIEF DESCRIPTION OF THE DRAWINGS

A full understanding of the invention will be had from the following detailed description of some ball point pens embodying the invention, reference being made to the accompanying drawings, in which.

DESCRIPTION OF THE PREFERRED EMBODIMENT

Figure 1:
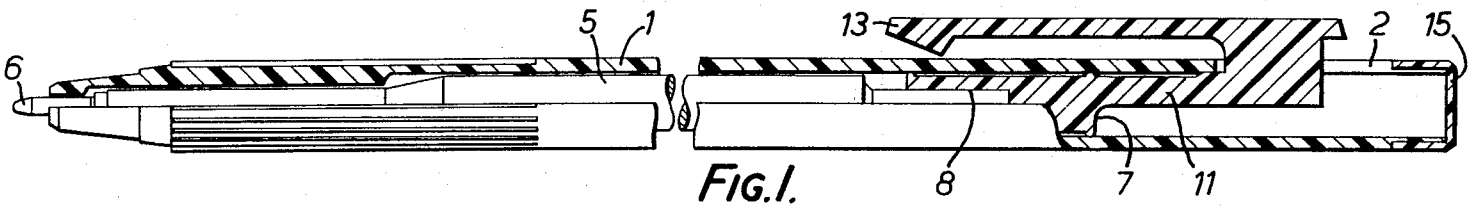
FIG. 1 is a side view shown partly in section of a first embodiment.
Figure 3:
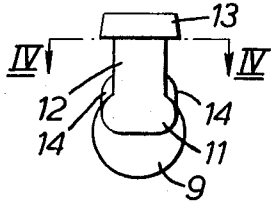
FIG. 3 is a rear end view of the slide member.
Figure 5:
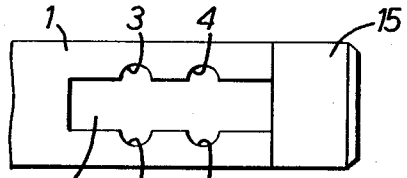
FIG. 5 is a rear end view of the pen body.
Figure 2:
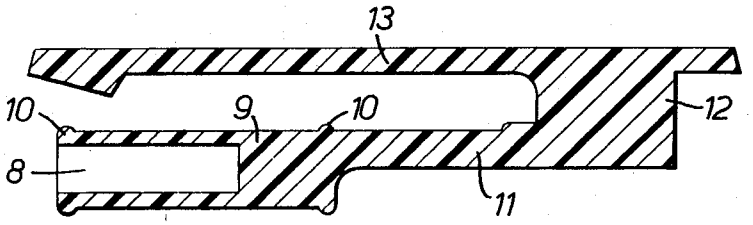
FIG. 2 is a larger scale section through the slide member.
Figure 4:
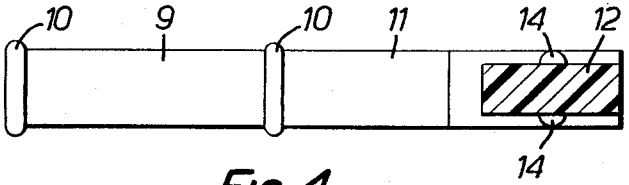
FIG. 4 is a view taken along the line IV—IV in FIG. 3.

The pen illustrated in FIGS. 1 to 5 has a plastic body or barrel 1 with a stepped-through bore and a longitudinal slot 2 extending forwardly a short distance from the rear end. The side edges of the slot 2 are provided with two pairs of opposed notches 3, 4 (FIG. 5) spaced apart along the slot and the purpose of which will become clear. Received in the bore are a writing unit 5 including ink reservoir and writing tip 6, and a slide member 7, the rear end of the writing unit being received with a tight friction fit in a socket 8 of the slide member, whereby the writing unit and slide member are coupled to move together. The slide member includes a cylindrical first part 9 having integral collars 10 which are dimensioned to make a good sliding fit in the bore of the barrel. The collars reduce the contact area and hence the friction between the slide member and the barrel but at the same time ensure that the slide member is guided for smooth sliding movement axially of the bore. A second part of the slide member consists of a rearwardly extending arm 11 integral with the part 9. The arm 11 is resiliently flexible and constitutes a cantilever spring. Carried on the free end of arm 11 is a radially projecting tongue 12 which supports an integral pocket clip 13. On either side of the tongue are detent lugs 14. The tongue 12 passes through the slot 2 in the barrel, and the lugs 14 are adapted to engage in the notches 3 or 4 under the bias of the spring arm 11 for locking the slide member 7 in its adjusted position. In a forward position of the slide member, the writing tip projects at the front end of the barrel and the lugs 14 engage in notches 3. To retract the writing tip, the pocket clip 13 is pressed towards the barrel to deflect the arm 11 and disengage the lugs 14 from the notches 3, and is then pushed back along the barrel. A cap 15 is fitted to the end of the barrel and acts as a stop to limit the rearward displacement of the slide member. When the clip 13 is released, the lugs 14 engage in the notches 4 under the bias of the spring arm and lock the writing tip in the retracted position. To extend the writing tip, the operation is reversed.

Figure 6:
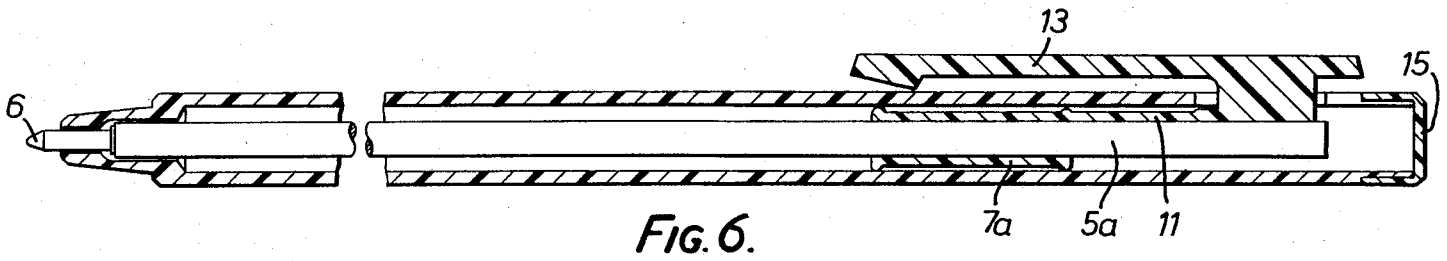
FIG. 6 is an axial section through a second embodiment.

The pen of FIG. 6 differs from that of FIGS. 1 to 5 in that the slide member 7*a* has a through bore through which the writing unit 5*a* extends. In this case at least the rear end portion of the writing unit 5*a* must be flexible since it must flex when the arm 11*a* is deflected to disengage the detent lugs from the locking notches.

Figure 7:
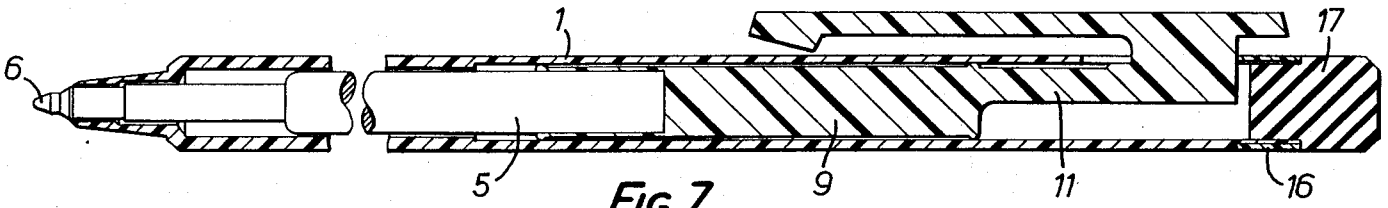
FIG. 7 is an axial section through a third embodiment.

The main differences between the pen shown in FIG. 7 and the embodiment of FIGS. 1 to 5 are that the first part 9 of the slide member 7 is longer and has a greater diameter, and in place of the end cap 15 a sleeve 16 and an eraser 17 are fitted to the end of the barrel 1. Except for the differences mentioned, the pens of FIGS. 6 and 7 are essentially the same as the first embodiment.

In the preferred embodiments of the invention as described above, the slide member is moved in both directions between the forward and retracted positions by manipulating the pocket clip 13. However, if desired, a return spring could be incorporated in a marking instrument according to the invention to assist in retracting the slide member and the writing unit. Such return springs are well known in retraction mechanisms for writing instruments.

We claim:

1. A marking instrument comprising a body having a longitudinal bore, a marking element accommodated in the bore, a member received in the bore for moving the tip of the marking element from a retracted position to an extended position relative to the body, detent means on the member and body engageable under a spring bias for locking the member releasably in an extended position in the bore and a projection on the member protruding through the slot and providing means external to the slot for disengaging the detent means and for adjusting the member from a retracted position to an extended position, characterized in that the member is a slide member including a first and a second part, said first part including means to receive the rear end of the marking member so that the marking and slide members are adapted to move together and a plurality of collars in close sliding fit with the bore at positions spaced apart along the first part so that the slide member is guided for movement axially along the bore and so that the first part provides firm lateral support for the writing element, said second part operationally communicating with and projecting longitudinally from the first part and including a resiliently flexible, rearwardly extending arm which is a cantilever spring providing the spring bias for the detent means and carrying said projection for disengaging the detent means.

2. An instrument according to claim 1, characterized in that the first and second parts of the slide member are formed integrally with each other.

3. An instrument according to claim 1, characterized in that the detent means comprises a protrusion on the cantilever spring and a recess in the body engageable by the protrusion.

4. An instrument according to claim 3, characterized in that the recess comprises a notch in the body at the side of the slot.

5. An instrument according to claim 4, characterized in that the projection on the spring comprises an integral tongue and the protrusion is formed on the side of the tongue.

6. An instrument according to claim 3 characterized in that the detent means is arranged to lock the slide member releasably in both the extended and the retracted position.

7. An instrument according to claim 1, characterized in that the projection on the spring comprises a pocket clip.

8. An instrument according to claim 1 wherein the first part is substantially cylindrical.

* * * * *